US006257791B1

(12) United States Patent
Scamard

(10) Patent No.: US 6,257,791 B1
(45) Date of Patent: Jul. 10, 2001

(54) TOOTHBRUSH WITH INTEGRATED TOOTHPASTE DISPENSER

(76) Inventor: David Franklin Scamard, 18106 Princess Point Cir., Tampa, FL (US) 33647

( * ) Notice: Subject to any disclaimer, the term of this patent is extended or adjusted under 35 U.S.C. 154(b) by 0 days.

(21) Appl. No.: 09/583,025

(22) Filed: May 30, 2000

(51) Int. Cl.[7] ..... A46B 11/04; A47L 13/22

(52) U.S. Cl. ..... 401/286; 401/145; 401/157; 401/183; 401/188 R; 401/276; 401/282; 222/209

(58) Field of Search ..... 401/136, 145, 401/146, 152, 157, 183, 184, 186, 188 R, 276, 282, 284, 286, 287, 289; 222/209

(56) References Cited

U.S. PATENT DOCUMENTS

| | | | | |
|---|---|---|---|---|
| 3,256,894 | * | 6/1966 | Sherman | 401/188 R |
| 3,261,367 | * | 7/1966 | Pickering | 401/287 |
| 4,826,341 | * | 5/1989 | Kwak | 401/286 |
| 5,338,124 | * | 8/1994 | Spicer et al. | 401/184 |

* cited by examiner

*Primary Examiner*—Gregory L. Huson
*Assistant Examiner*—Tuan Nguyen

(57) ABSTRACT

A toothbrush with integrated toothpaste dispenser includes a brush section, a handle section and an intermediate neck section. Positioned among the bristles of the brush section is a soft, flexible tube—the external end of which is just below the level of the ends of the bristles. This flexible tube allows for the delivery of the toothpaste to the ends of the bristles in an efficient and practical manner. Within the handle section resides a reservoir of toothpaste. The intermediate neck section is hollow, which forms a communicating channel for the toothpaste to travel from the toothpaste reservoir in the handle to the toothbrush head. Dispensing of the toothpaste can be accomplished by any manner of delivery system. The types of delivery systems possible include, but are not limited to: pump systems, lever systems, screwdiven systems and roller systems. The toothpaste reservoir located in the handle section of the toothbrush holds enough toothpaste to last the usefull life of the toothbrush bristles—thereby preventing the toothbrush from being used past its useful and effective life—which equates to healthier teeth and gums.

2 Claims, 3 Drawing Sheets

TOOTHBRUSH WITH INTEGRATED TOOTHPASTE DISPENSER

| U.S. Patent Documents | | | |
|---|---|---|---|
| 4692047 | Sep., 1987 | Endo | 401/150 |
| 5158383 | Oct., 1992 | Glover et al. | 401/150 |
| 5393153 | Feb., 1995 | Bouthillier | 401/150 |
| 5909977 | Jun., 1999 | Kuo | 401/150 |
| 5908257 | Jun., 1999 | Martin | 401/150 |
| 5918995 | Jul., 1999 | Puurunen | 401/150 |
| 5918996 | Jul., 1999 | Coolbaugh | 401/150 |
| 6039489 | Mar., 2000 | Harman, et al. | 401/150 |
| **Foreign Patent Documents** | | | |
| 523340 | Apr., 1956 | CA | 401/150 |
| 3514600 | Aug., 1986 | DE | 401/150 |

DESCRIPTION

The present invention relates to a toothbrush with integrated toothpaste dispenser comprising a brush portion, an intermediate neck portion and a handle portion—whereby the handle portion comprises a container portion for a dental cleansing medium (toothpaste). The dispensing of the toothpaste from the container portion to the brush portion is accomplished by a dispensing mechanism located within the handle portion. Said mechanism can be one of any number of various designs which include, but are not limited to pump designs, lever designs, screw-driven designs and roller-type designs. Said mechanism causes a transient increase in pressure within the toothpaste container—forcing the toothpaste from the toothpaste reservoir, through the communicating channel within the intermediate neck portion, through the soft, flexible toothpaste delivery tube to the exposed ends of the toothbrush bristles.

Several solutions for a toothbrush with integrated toothpaste dispenser have been proposed. These previously proposed solutions have had the disadvantage of being impractical, ineffective, complicated, expensive to produce and untidy in operation.

Toothbrushes of this type are disclosed, for example, in U.S. applications U.S. Pat. No. 4,717,278, U.S. Pat No. 5,096,321, U.S. Pat. No. 4,963,046, U.S. Pat No. 5,393,153, U.S. Pat. No. 5,908,257, U.S. Pat. No. 5,918,995 and U.S. Pat. No. 5,918,996. None of the solutions disclosed in these publications have the ability to effectively, practically and controllably dispense the toothpaste to the toothbrush bristles' exposed ends.

The objective of the present invention is to remedy the aforementioned defects to obtain a toothbrush with an integrated toothpaste dispenser which is reliable, practical in application, effective in purpose, cost-effective to manufacture and user-friendly in efficiency, ease of use and tidiness. This objective is achieved by means of the toothbrush with integrated toothpaste dispenser according to the present invention.

For the sake of hygiene and dental health, the present invention is intended to be disposable—analogous to conventional toothbrushes. The amount of toothpaste contained within the toothpaste container located within the handle section of the toothbrush should not exceed that amount that is expected to last the useful lifetime of the toothbrush bristles; i.e.: once the reservoir of toothpaste within the handle section of the toothbrush has been exhausted, the need to replace the toothbrush due to the wear on the toothbrush bristles should coincide. This feature will prevent over-use of the toothbrush—which will equate to healthier teeth and gums for the user. Although the present invention is intended to have a useful life-span comparable to conventional toothbrushes, single use and reusable versions are also conceivable. A reusable version could have a replaceable toothpaste cartridge and a replaceable brush head section with a reusable handle portion or body.

In the following, a preferred embodiment of the present invention will be described in detail with reference to the enclosed schematic drawing in which the toothbrush with integrated toothpaste dispenser is illustrated with a simple pump as the toothpaste dispensing mechanism:

DETAILED DESCRIPTION OF THE PREFERRED EMBODIMENT

Figure 1:
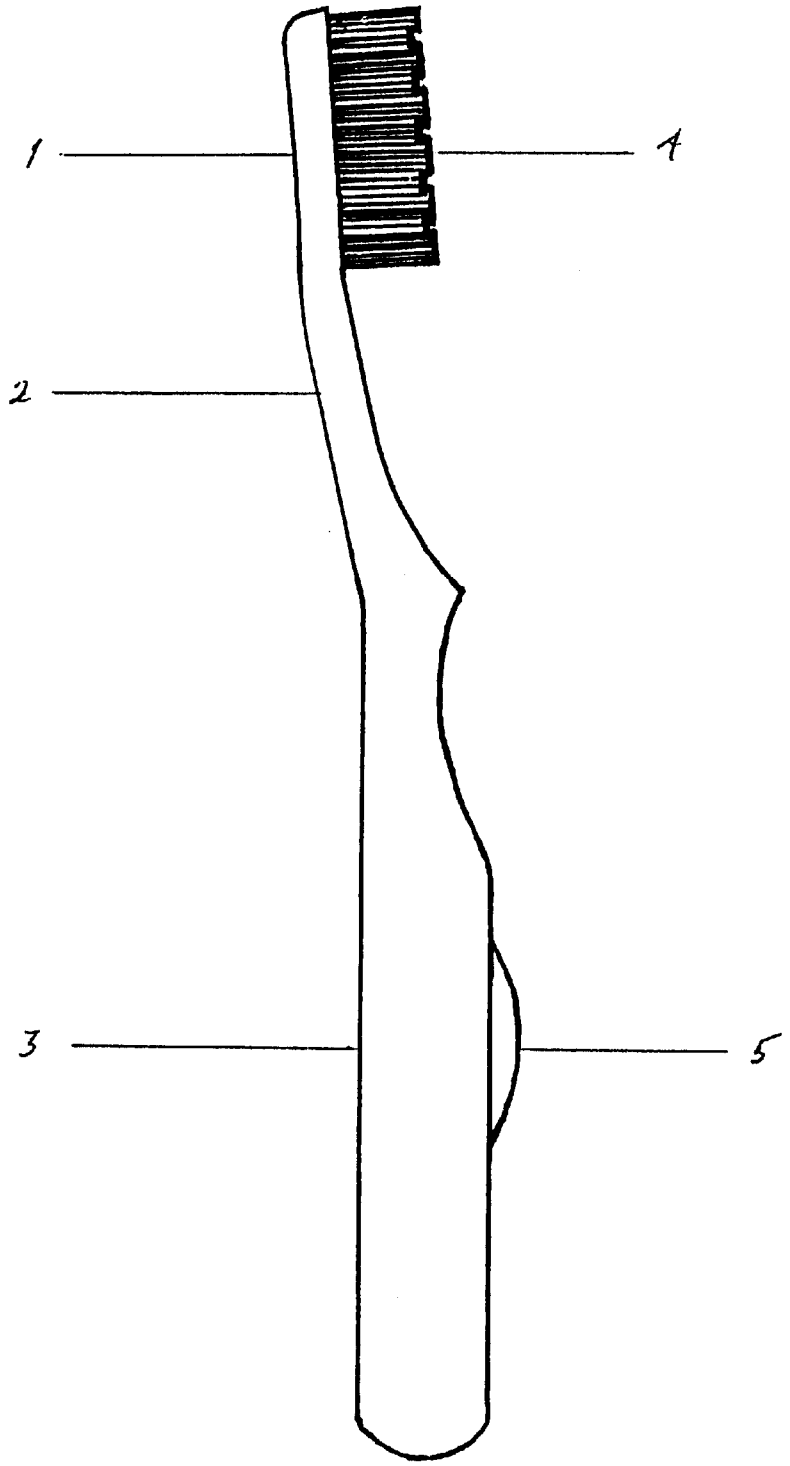
FIG. 1 shows a side-view of the toothbrush with integrated toothpaste dispenser according to the invention.
Figure 2:
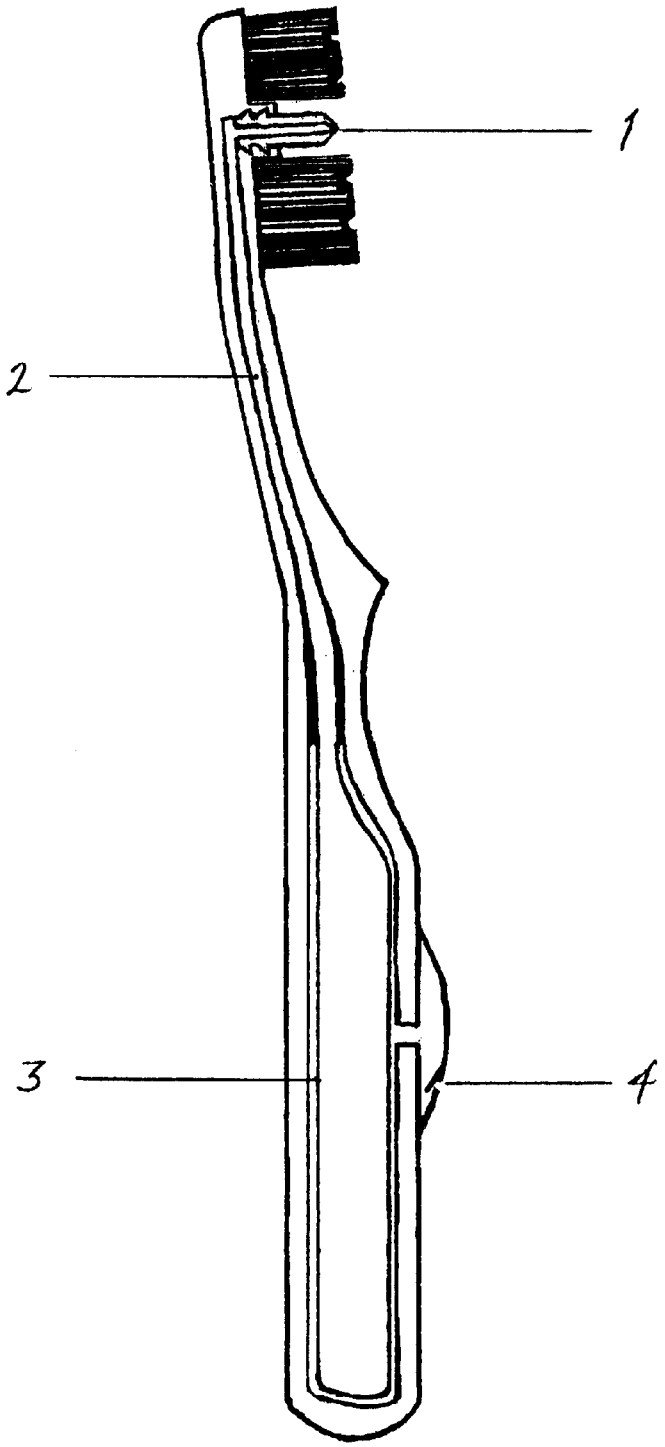
FIG. 2 shows a cross-sectional view of the toothbrush with integrated toothpaste dispenser according to the invention.
Figure 3:
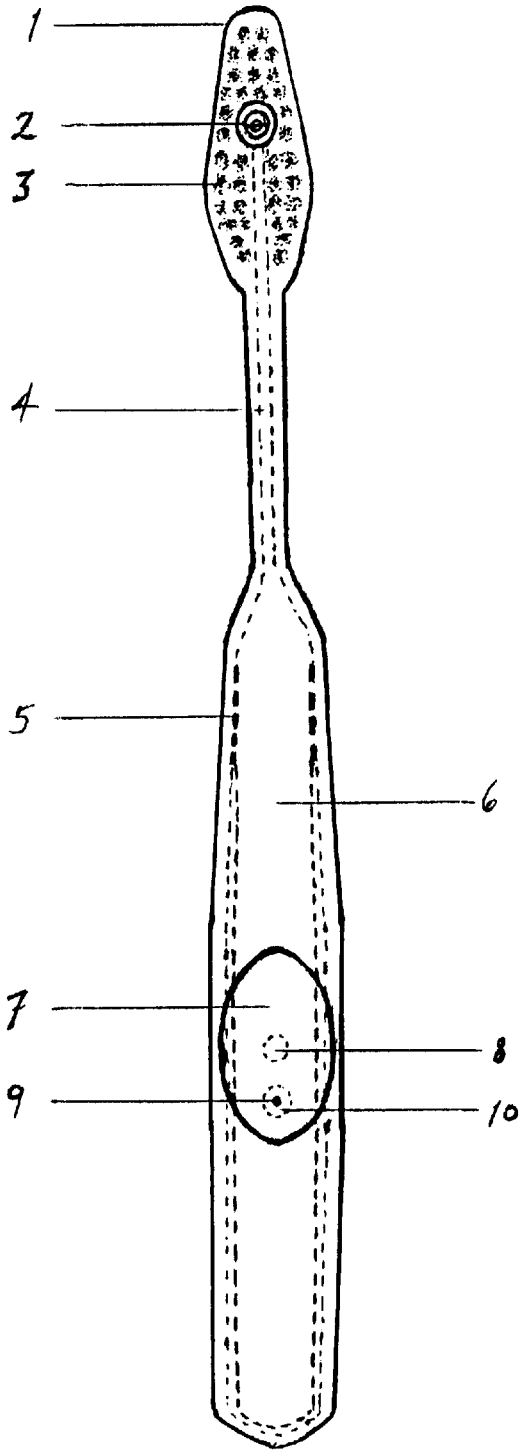
FIG. 3 shows a frontal view of the toothbrush with integrated toothpaste dispenser according to the invention.

Referring to the drawings, FIGS. 1, 2 and 3 illustrate the toothbrush of the present invention which is adapted to contain and dispense a significant quantity of toothpaste. The toothbrush generally comprises a brush section 1, an intermediate neck section 2, a handle section 3 and a dispensing mechanism 5.

FIG. 2 illustrates a toothpaste dispensing tube 6, the communicating channel 7, the hollow handle section 3 which resides therein a toothpaste container 8, the simple pump dispensing mechanism 5, the air-flow duct 9, that allows for air to flow, from the simple pump dispensing mechanism 5 to the interior of the handle section 3, and the valve assembly 10 which is showing the valve in the open position for illustrative purposes. FIG. 3 illustrates the brush section 1, the toothpaste dispensing tube 6, the toothbrush bristles 4, the communicating channel 7, the toothpaste container 8, the seal 11 between the toothpaste container 8 and the communicating channel 7, the simple pump dispensing mechanism 5, the air-flow duct 9, an air inlet orifice 12 of the valve assembly 10 of the simple pump dispensing mechanism 5, and a valve 13 which is attached on one side of the underside of the pump 5 covering the air inlet orifice 12.

The handle section 3 preferably forms an elongate shell which is adapted to house a toothpaste container 8 which is closed at one end and attached by the seal 11 at the other end to the communicating channel 7. The toothpaste container 8 is comprised of a collapsible membrane filled with toothpaste.

The simple pump dispensing mechanism 5 is attached with an air-tight seal to the handle portion 3. It is composed of a flexibly reversible material. The valve 13 is also composed of a flexibly reversible material. The valve 13 is attached on one side to the underside of the pump 5, forming a hinged valve. It is positioned to cover the air inlet orifice 12. When the user depresses the pump 5, the valve 13 seals the air inlet orifice 12. Depression of the pump 5 causes the air within the pump 5 to flow through the air-flow duct 9 into the interior of the handle 3 which causes a transient increase in pressure upon the toothpaste container 8. When the user releases the pump 5, the pump 5 returns to its original shape—allowing air from the surrounding atmosphere to enter the pump 5 through the air inlet orifice 12. Air flowing into the pump 5 through the air inlet orifice 12 causes the valve 13 to open. Once the pump 5 has returned to its original shape, the valve 13 closes—forming an air-tight seal which readies the pump 5 for the next compression by the user.

When the pump 5 is actuated by the user, air flows into the space between the interior of the handle 3 and the toothpaste container 8. This air flow causes a transient increase in pressure upon the toothpaste container 8, forcing toothpaste from the container 8, through the communicating channel 7, through the toothpaste dispensing tube 6, and onto the exposed ends of the toothbrush bristles 4. The toothpaste dispensing tube 6 is composed of a soft flexible material. The terminal, open end of the toothpaste dispensing tube 6 is tapered, forming a valve. As toothpaste is forced from the end of the toothpaste dispensing tube 6, the valve opens, allowing toothpaste to exit. Once the pressure equalizes within the toothbrush handle 3 due to the escape of the toothpaste, the toothpaste ceases to exit from the end of the dispensing tube 6 and the valve closes. The closure of the valve prevents any foreign material from entering the toothpaste dispensing tube 6 and contaminating the toothpaste.

It is noted that the embodiment of the toothbrush with integrated toothpaste dispenser described herein in detail for exemplary purposes is, of course, subject to many different variations in structure, design, application and methodology. Due to the many varying and different embodiments that may be made within the scope of the inventive concept(s) herein taught, and due to the many modifications that may be made in the embodiment herein detailed in accordance with the descriptive requirements of the law, it is to be understood that the details herein are to be interpreted as illustrative and not in a limiting sense.

What is claimed is:

1. A toothbrush with integrated toothpaste dispenser comprising: a brush portion, a handle portion and an intermediate neck portion; wherein the handle portion comprising a toothpaste reservoir for containing toothpaste therein and a dispensing mechanism located at an intermediate portion of the handle for delivering the toothpaste from the handle portion through the neck portion to the brush portion; wherein the brush portion comprises toothbrush bristles and at least one soft flexible toothpaste dispensing tube, the at least one dispensing tube having a terminal open end located just below the exposed ends of the bristles, so as not to interfere with the dental cleaning efficiency of the bristles yet allowing the toothpaste to be dispensed directly adjacent the exposed ends of the toothbrush bristles where the toothpaste is needed; the toothpaste reservoir is located within the handle portion of the toothbrush and comprising a container consisting of a collapsible membrane housing for containing toothpaste and having an open end; wherein the open end of the container is attached to a communicating channel of the intermediate neck portion and forming a seal with the channel; and wherein the dispensing mechanism located at the intermediate portion of the handle is an air pump device that, when actuated, exerts a pressure on the collapsible membrane housing within the handle portion and thereby depresses the collapsible membrane housing in the handle portion for forcing the toothpaste from the toothpaste container, through the communicating channel of the intermediate neck portion, through the soft, flexible toothpaste dispensing tube to the exposed ends of the toothbrush bristles.

2. The toothbrush with integrated toothpaste dispenser according to claim 1, wherein the toothpaste dispensing tube is positioned among the bristles and is oriented parallel to the orientation of the bristle, the toothpaste dispensing tube is composed of a soft, flexible material so as not to cause any damage to the toothbrush users teeth; wherein the terminal, openable end of the toothpaste dispensing tube is tapered to define a valve to allow for the outward flow of toothpaste from the tube, while preventing any foreign material from entering the tube and contaminating the toothpaste within the tube.

* * * * *